US010197970B2

(12) United States Patent
Kitajima

(10) Patent No.: US 10,197,970 B2
(45) Date of Patent: Feb. 5, 2019

(54) PROCESS UNIT HAVING A SEAL MEMBER THAT SEALS A SPACE BETWEEN A FLANGE AND A PORTION SUPPORTING A FLANGE

(71) Applicant: CANON KABUSHIKI KAISHA, Tokyo (JP)

(72) Inventor: Tomoharu Kitajima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/209,994

(22) Filed: Jul. 14, 2016

(65) Prior Publication Data

US 2017/0031311 A1 Feb. 2, 2017

(30) Foreign Application Priority Data

Jul. 27, 2015 (JP) ..... 2015-147430

(51) Int. Cl.
*G03G 21/18* (2006.01)
*G03G 15/00* (2006.01)

(52) U.S. Cl.
CPC ..... *G03G 21/1839* (2013.01); *G03G 15/751* (2013.01); *G03G 21/1867* (2013.01); *G03G 2221/1648* (2013.01)

(58) Field of Classification Search
CPC .. G03G 21/1839; G03G 15/75; G03G 15/751; G03G 21/20; G03G 21/1867; G03G 2221/1648
See application file for complete search history.

(56) References Cited

U.S. PATENT DOCUMENTS

| | | | | |
|---|---|---|---|---|
| 5,021,830 | A * | 6/1991 | Koiso | G03G 15/0817 399/102 |
| 8,380,101 | B2 | 2/2013 | Kakitani | |
| 2007/0059030 | A1 * | 3/2007 | Suzuki | G03G 21/007 399/102 |
| 2010/0232825 | A1 | 9/2010 | Kakitani | |
| 2017/0090404 | A1 * | 3/2017 | Yoshikawa | G03G 21/18 |

FOREIGN PATENT DOCUMENTS

| | | | |
|---|---|---|---|
| JP | S62-164373 | U | 10/1987 |
| JP | H05-81847 | U | 11/1993 |
| JP | H05-333752 | A | 12/1993 |
| JP | 2010-210990 | A | 9/2010 |
| JP | 5355153 | B2 | 11/2013 |

* cited by examiner

*Primary Examiner* — David M. Gray
*Assistant Examiner* — Laura Roth
(74) *Attorney, Agent, or Firm* — Venable LLP

(57) ABSTRACT

A process unit includes an image bearing body, a flange provided on an end portion of the image bearing body, and a supporting portion that rotatably supports a rotational axis portion provided on the flange. A seal is provided that to seal at least a part of a space formed between the supporting portion and the flange.

18 Claims, 15 Drawing Sheets

PROCESS UNIT HAVING A SEAL MEMBER THAT SEALS A SPACE BETWEEN A FLANGE AND A PORTION SUPPORTING A FLANGE

BACKGROUND OF THE INVENTION

Field of the Invention

The present invention relates to a process unit and an image forming apparatus.

Description of the Related Art

In order to support a photosensitive drum (image bearing member) having a flange at an end portion of the photosensitive drum, the configuration is employed in which a rotational axis is protruded from an end surface of the flange in the direction of rotational axis of the photosensitive drum (Japanese Utility Model Application Publication Hei 5-81847). In this configuration, if a bearing becomes in contact with an end surface of the flange, a rotational load is given to the photosensitive drum. Thus, it is desirable to provide an interval between the bearing and the flange in order to prevent the photosensitive drum from receiving such rotational load.

However, an interval is provided between the bearing and the flange, it is possible for scattered toner to deposit on the end surface of the flange of the photosensitive drum. In particular, when a photosensitive drum of a long life type is used, a toner deposition amount may become large. Thus, the configuration is desired in which toner does not deposit on the flange even when the photosensitive drum is used for a long time.

SUMMARY OF THE INVENTION

An object of the present invention is to provide a process unit or an image forming apparatus capable of suppressing toner from depositing on a flange.

A representative configuration of the present invention is a process unit which is detachably attachable to an image forming apparatus, comprising:

an image bearing body which bears an image formed with developer, the image bearing body being configured to be rotatable;

a flange provided on an end portion of the image bearing body;

a rotational axis for rotating integrally with the image bearing body, the rotational axis being configured to protrude from the flange toward the outside of the image bearing body in the longitudinal direction of the image bearing body, the outer diameter of the rotating axis being less than the outer diameter of the image bearing body;

a supporting portion which rotatably supports the rotational axis; and a seal member which seals at least a part of a space formed between the supporting portion and the flange.

Another representative configuration of the present invention is an image forming apparatus, comprising:

an image bearing body which bears an image formed with developer, the image bearing body being configured to be rotatable;

a flange provided on an end portion of the image bearing body;

a rotational axis for rotating integrally with the image bearing body, the rotational axis being configured to protrude from the flange toward the outside of the image bearing body in the longitudinal direction of the image bearing body, the outer diameter of the rotating axis being less than the outer diameter of the image bearing body;

a supporting portion which rotatably supports the rotational axis, the supporting portion being provided in the image forming apparatus; and a seal member which seals at least a part of a space formed between the supporting portion and the flange.

Further features of the present invention will become apparent from the following description of exemplary embodiments with reference to the attached drawings.

DESCRIPTION OF THE EMBODIMENTS

Hereinafter, the description will be made in detail to an embodiment of the present invention with reference to the drawings.

First Embodiment

Hereinafter, the embodiment of the present invention will be explained. The dimensions, the material, the shape, the relative arrangement and so on of the components disclosed in this embodiment are not intended to limit the scope of the present invention only to them unless otherwise specifically noted.

(Overall Configuration of the Image Forming Apparatus)

The overall configuration of the image forming apparatus of the present invention will be explained.

Figure 1:
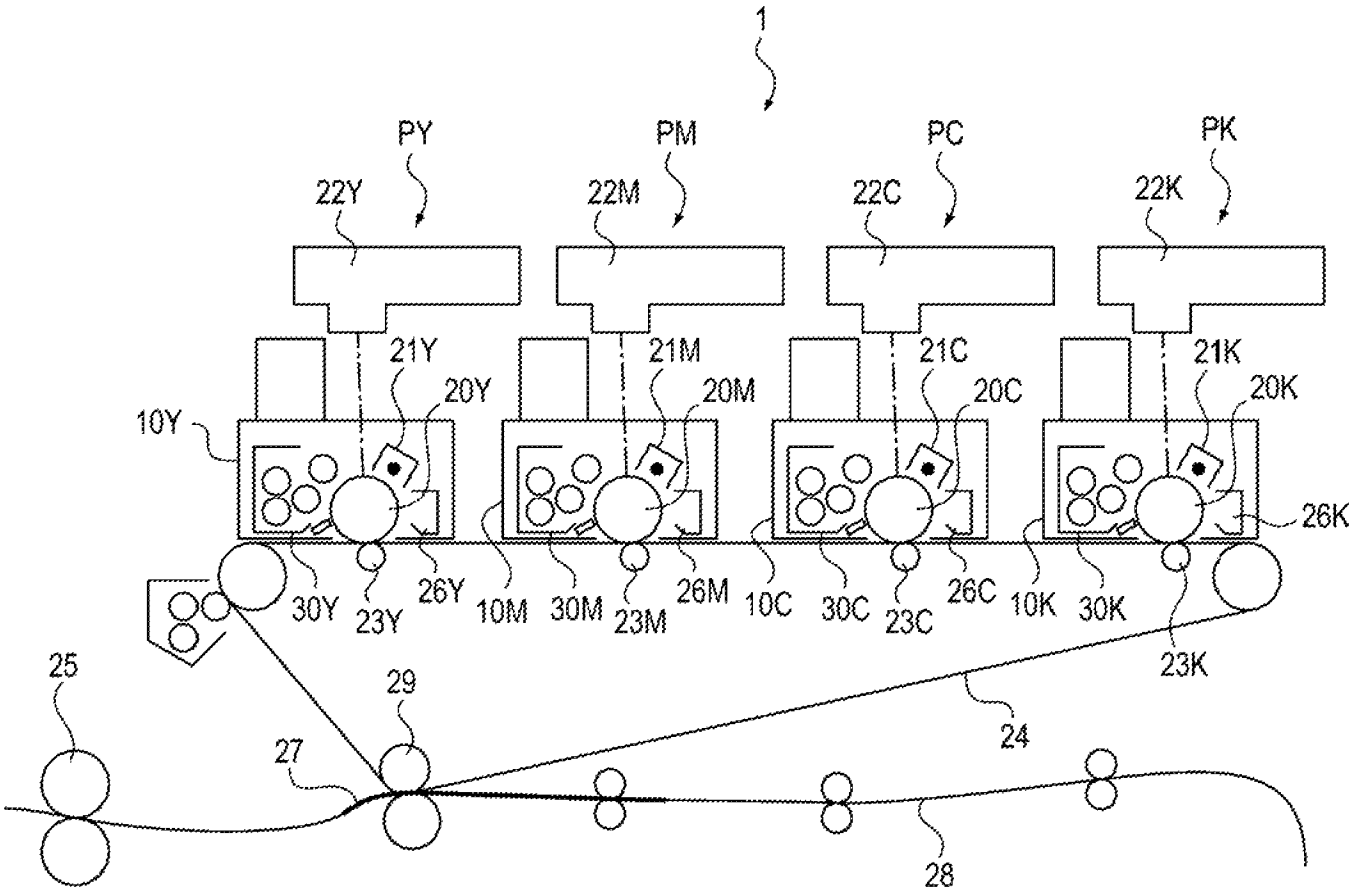
FIG. 1 is a diagram of a schematic cross-sectional view of an image forming apparatus according to an embodiment of the present invention.

FIG. 1 is a diagram of a schematic cross-sectional view of an image forming apparatus according to an embodiment of the present invention.

As illustrated in the figure, the image forming apparatus 1 has image forming units for forming an image using the toners of yellow Y, magenta M, cyan C and black Bk respectively. The image forming units PY, PM, PC and PK are of the same configuration except for the toner color.

The image forming units will be explained by taking up the image forming unit PY as a representative. The photosensitive drum 20Y (image bearing member) is provided rotatably. The surface of the rotating photosensitive drum 20Y is uniformly charged by the primary charger 21Y. Then the uniformly charged surface is exposed by the exposure device 22Y such as a laser device in accordance with an information signal to form an electrostatic latent image on the outer peripheral surface of the photosensitive drum 20Y. The formed electrostatic latent image is visualized on the photosensitive drum 20Y as a toner image (a developer image) by the developing device 30Y. In this embodiment, the two-component developing system using toner and carrier is employed.

Next, the toner image visualized on the photosensitive drum 20Y is transferred to the intermediate transfer belt 24 by the primary transfer portion 23Y. Such steps are performed in each image forming unit to form a color image on the intermediate transfer belt 24. The toner image formed on the intermediate transfer belt 24 is conveyed to the secondary transfer portion 29 where the toner image is secondarily transferred to the recording material 27 which has been conveyed on the sheet conveying path 28. The toner image is fixed on the recording material 27 with heat and pressure by the fixing device 25. The toner remaining on the photosensitive drum 20Y is removed by the drum cleaner 26Y.

The photosensitive drum 20Y, the developing device 30Y, the primary charger 21Y and the drum cleaner 26Y are provided in the process unit 10Y.

Since the configurations of the image forming unit are the same except for the toner color, the following explanation for the process unit 10, the developing device 30, the drum unit 40 having the photosensitive drum 20 and other components is commonly applicable to each color.

(Configuration of the Process Unit)

Next, the explanation will be made to the process unit 10.

Figure 2:
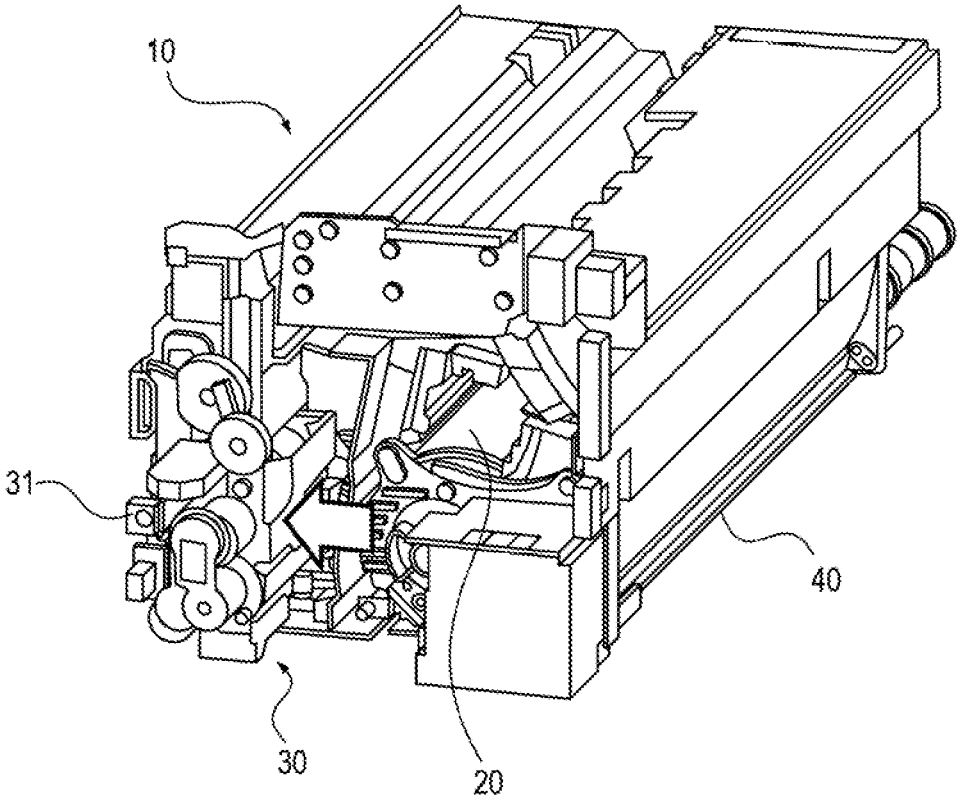
FIG. 2 is a diagram of a perspective view of a process unit according to the embodiment of the present invention.

FIG. 2 is a diagram of a perspective view showing the configuration of the process unit 10. Typically, the lifetime of the photosensitive drum 20 is shorter than that of the main body portion of the image forming apparatus 1. Thus, the photosensitive drum 20 is provided in the process unit 10 which can detachably attachable to the image forming apparatus 1. The process unit 10 is exchanged at a necessary time by a user or a serviceman.

The process unit 10 is configured such that the developing device 30 can be separated from the photosensitive drum 20. When the photosensitive drum 20 is pulled out from the process unit 10, it is necessary for the developing device to be separated from the photosensitive drum 20 or the drum unit 40 which includes the photosensitive drum 20.

Figure 3:
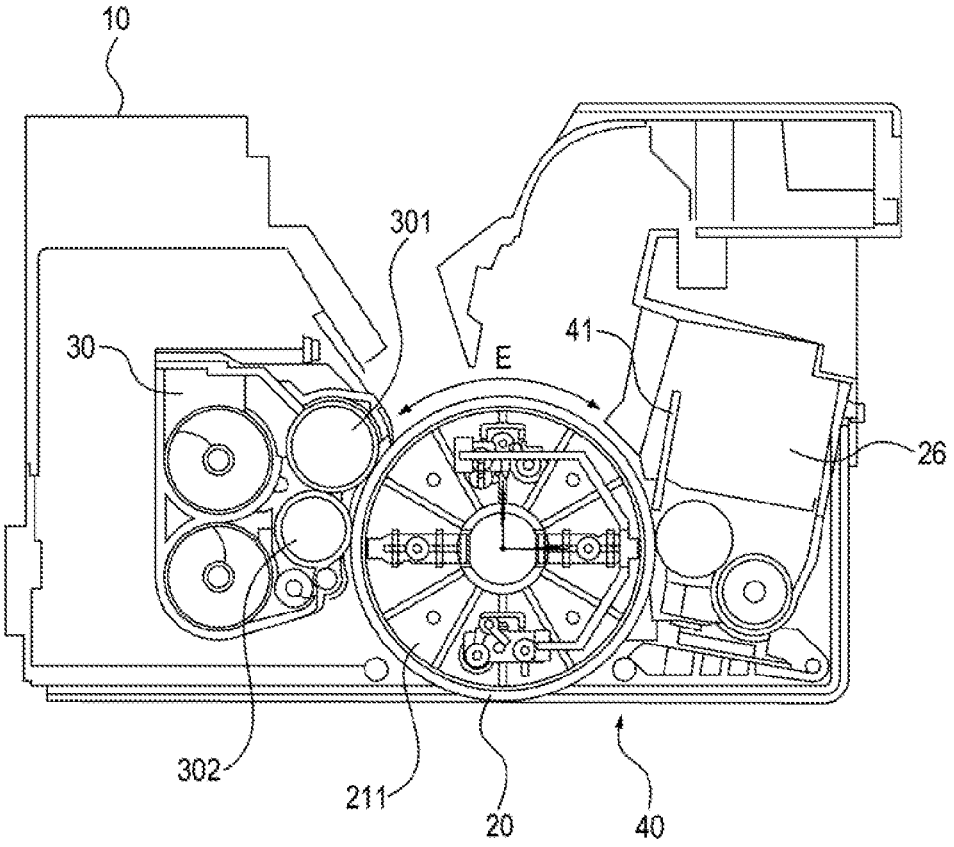
FIG. 3 is a diagram of a front view of the process unit showing a detailed configuration according to the embodiment of the present invention.

FIG. 3 is a diagram of a front view showing the detailed configuration of the process unit.

As shown in the figure, the developing device 30 has two developing sleeves 301 and 302. Further, the drum cleaner 26 has the cleaning blade 41 for removing toner remaining on the photosensitive drum 20.

In order to obtain stable images, it is necessary to stably maintain the surface distance between the photosensitive drum 20 and the developing sleeves 301 and 302 in the range of about 0.2 mm to about 0.5 mm. For this reason, the developing device 30 is pressed on the photosensitive drum 20 or the drum unit 40.

Figure 4:
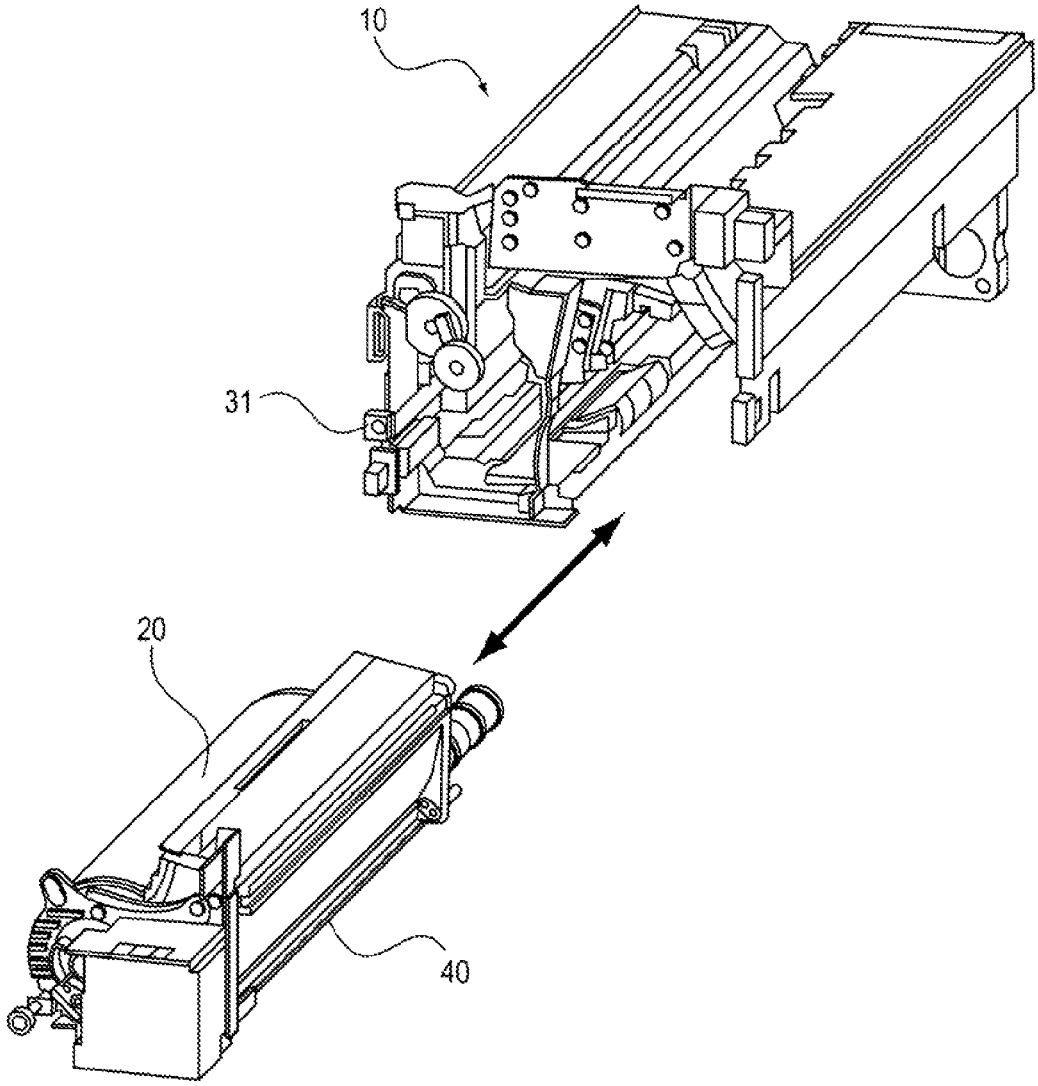
FIG. 4 is a diagram of a perspective view of the process unit showing the state where a drum unit is detachably attachable to the process unit when a developing device according to the embodiment of the present invention is pulled out from the process unit.

FIG. 4 is a diagram of a perspective view of the process unit 10 showing the state where the drum unit 40 is detachably attachable to the process unit 10 when the developing device 30 is pulled out from the process unit 10.

As shown in the figure, the developing device 30 is configured to be detachably attachable to the drum unit 40. In the state where the developing device 30 has been moved in the arrow direction of FIG. 2 or in the state where the developing device 30 has been pulled out from the process unit 10, the drum unit 40 can be inserted into or pulled out from the process unit 10.

Figure 5A:
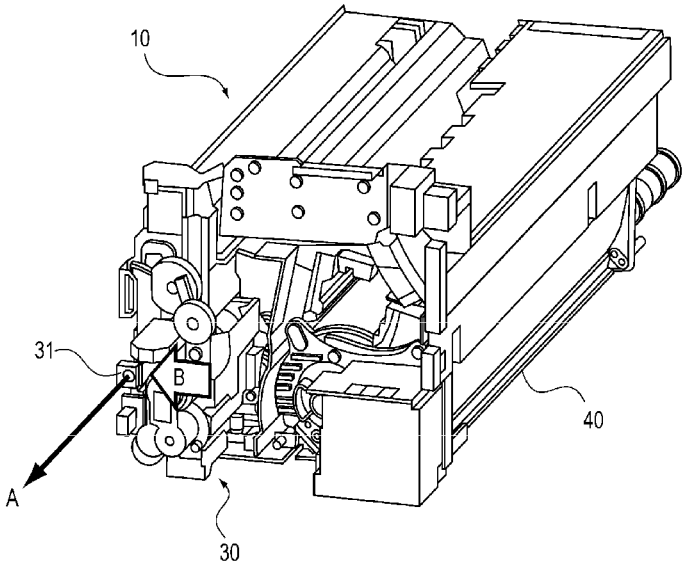
FIGS. 5A and 5B are diagrams of a perspective view showing the state where the developing device is moved in the process unit according to the embodiment of the present invention.
Figure 5B:
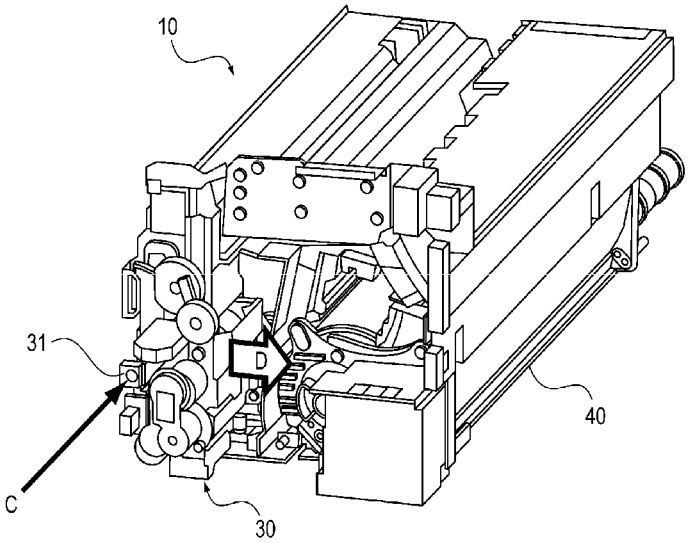

FIGS. 5A and 5B are diagrams of a perspective view showing the state where the developing device 30 is moved in the process unit 10. FIG. 5A shows the case where the developing device 30 is pulled out and FIG. 5B shows the case where the developing device 30 is attached.

In process unit 10, the developing device 30 can be attached to and detached from the drum unit 40 by operating the development pressing lever 31 as shown in FIGS. 5A and 5B.

Namely, as shown in FIG. 5A, when the development pressing lever 31 is moved in the direction A in the state where the developing device 30 is pressed on the drum unit 40 in the process unit 10, the developing device 30 is moved in the direction B and is separated from the drum unit 40 so that the developing device 30 and the drum unit 40 can be inserted into and be pulled out from the process unit 10.

When the development pressing lever 31 is moved in the direction C in the state where the developing device 30 and the drum unit 40 have been inserted into the process unit 10, the developing device 30 slides in the direction D of the figure and the developing device 30 is pressed on the drum 40 so that the surface distances between the photosensitive drum 20 and the image bearing members are stably maintained.

Figure 6:
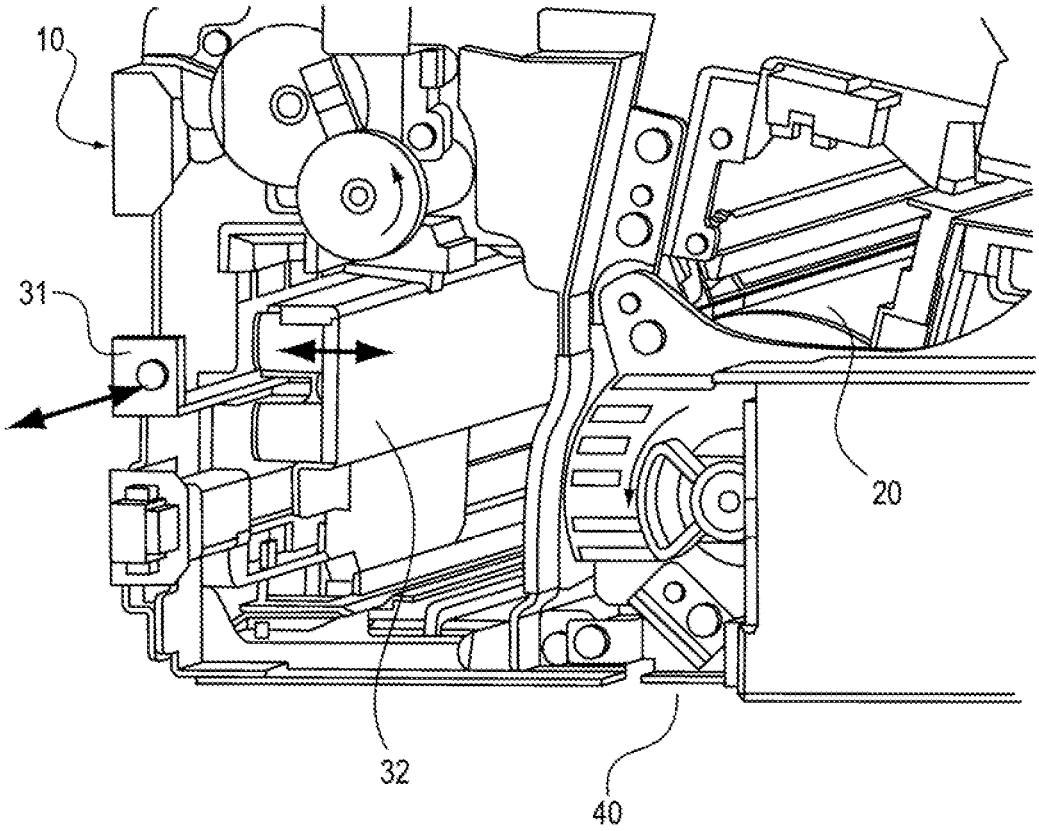
FIG. 6 is a diagram of a perspective view of the process unit showing the configuration for pressing the developing device to the photosensitive drum in the process unit according to the embodiment of the present invention.

FIG. 6 is a diagram of a perspective view of the process unit 10 showing the configuration for pressing developing device 30 to the photosensitive drum 20 in the process unit 10.

The process unit 10 having the developing device 30 and the photosensitive drum 20 is equipped internally with the pressing member 32 for pressing the developing device 30 on the photosensitive drum 20. By moving the development pressing lever 31 in the forward and backward directions, the pressing member 32 is moved in the right and left directions.

Specifically, the configuration is such that by pushing the development pressing lever 31 to the far side, the pressing member 32 moves from left to right and the pressing member 32 pushes the back surface of the developing device 30 so that the developing device 30 is pressed on the photosensitive drum 20. On the other hand, by pulling the development pressing lever 31 to the near side, the pressing member 32 is moved from right to left so that the developing device 30 is separated from the photosensitive drum 20.

Figure 7:
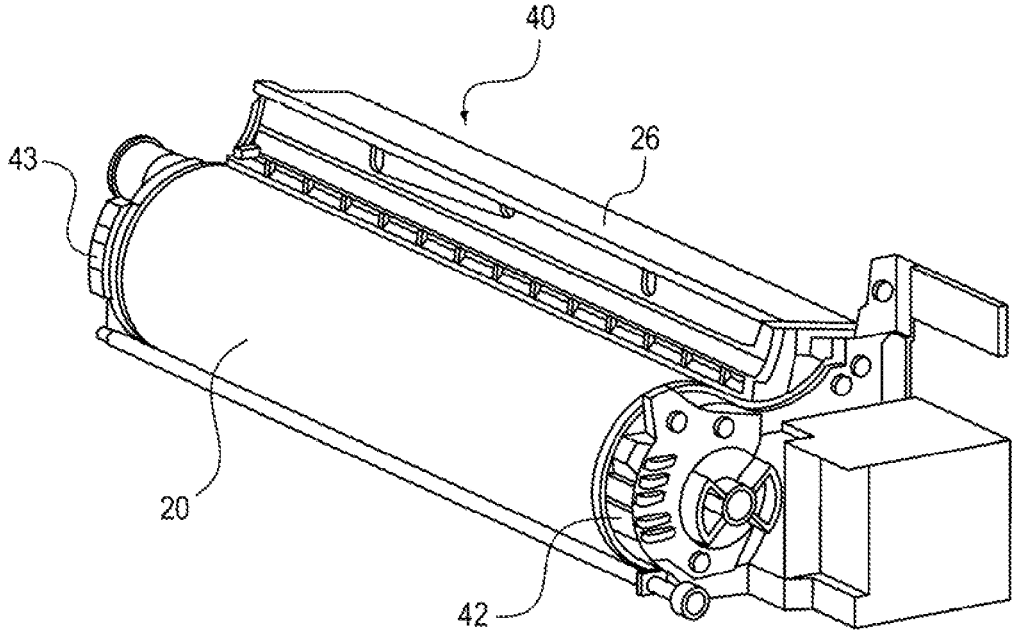
FIG. 7 is a diagram of a perspective view of the drum unit according to the embodiment of the present invention.

FIG. 7 is a diagram of a perspective view of the drum unit 40.

The photosensitive drum 20 is integrated with the drum cleaner 26 which removes transfer residue toner on the drum surface so as to form the drum unit 40 and the drum unit 40 can be inserted to and be pulled from the process unit 10 as shown in FIG. 4.

When the photosensitive drum 20 and a cleaning blade of the drum cleaner 26 are to be exchanged, the drum unit 40 is pulled out and is inserted by a serviceperson. At both longitudinal ends of the photosensitive drum 20, the drum supporting members 42 and 43 with which the developing device 30 is in contact when the developing device 30 is pressed on the drum unit 40 are disposed so as to sandwich the photosensitive drum 20. In order to be rotatable, the photosensitive drum 20 includes bearings with which the axes of the flange members 210 and 211 provided on both side surfaces of the photosensitive drum 20 engage.

Figure 8:
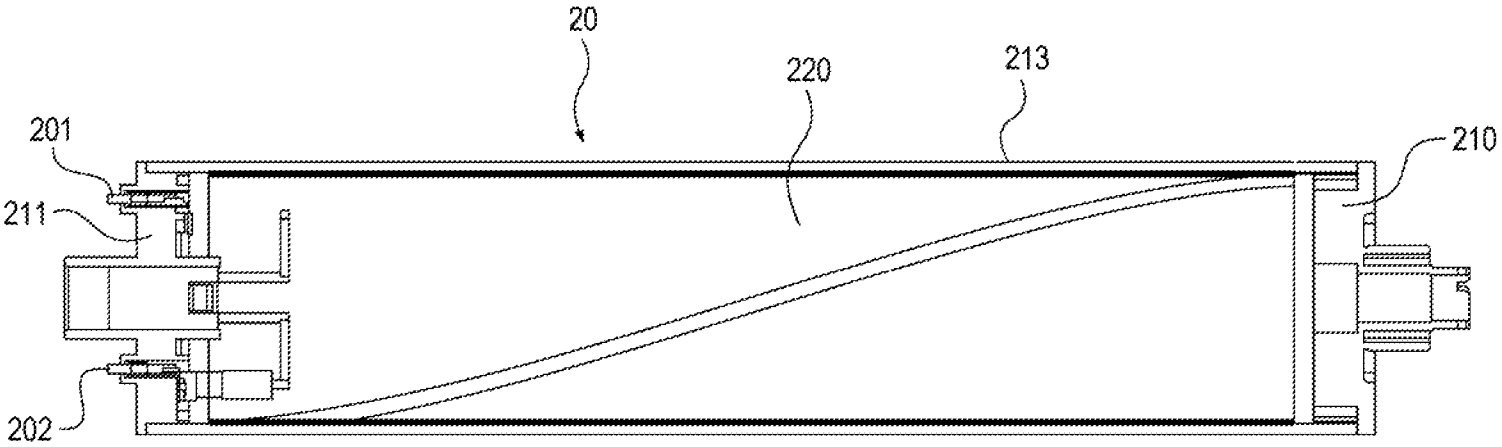
FIG. 8 is a diagram of a cross-sectional view of the photosensitive drum according to the embodiment of the present invention.

FIG. 8 is a diagram of a cross-sectional view of the photosensitive drum 20.

The photosensitive drum 20 to be used in an image forming apparatus of high-quality, high-speed, high-endurance has a heater for heating the photosensitive drum 20 in order to prevent condensation on the photosensitive drum 20 and to suppress image change due to temperature and humidity characteristics. Namely, in the photosensitive drum 20, the planar heater 220 which is formed in a cylindrical shape is integrated with the drum cylinder 213 at the inner surface of the drum cylinder 213 while the planar heater 220 is brought into close contact with the drum cylinder 213 in order to increase heat conduction efficiency. The planer heater 220 rotates with the drum cylinder 213 and the flange members 210 and 211 which are provided at both ends of the drum cylinder 213.

Figure 9:
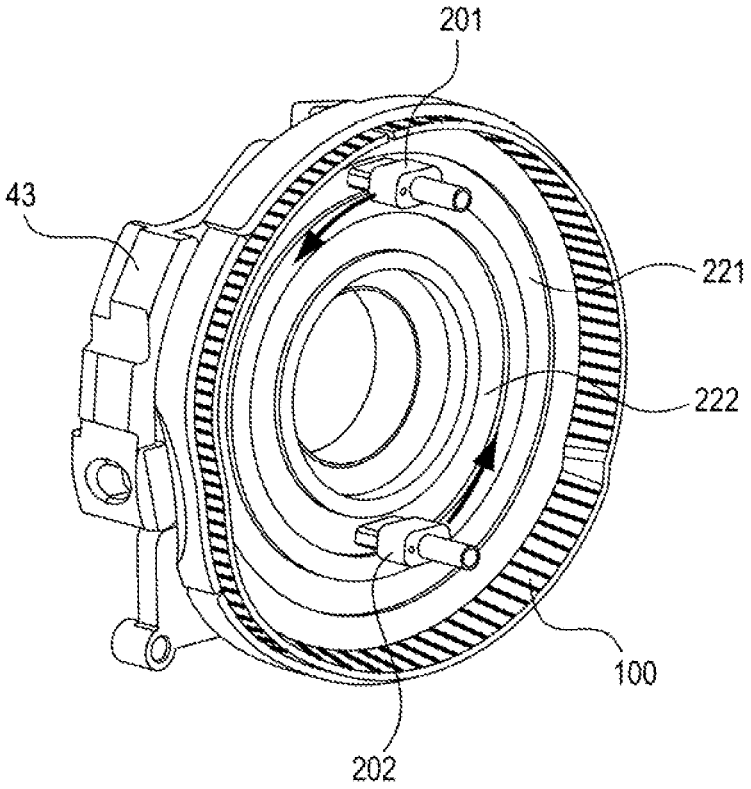
FIG. 9 is a diagram of a perspective view of a drum supporting member according to the embodiment of the present invention.
Figure 10:
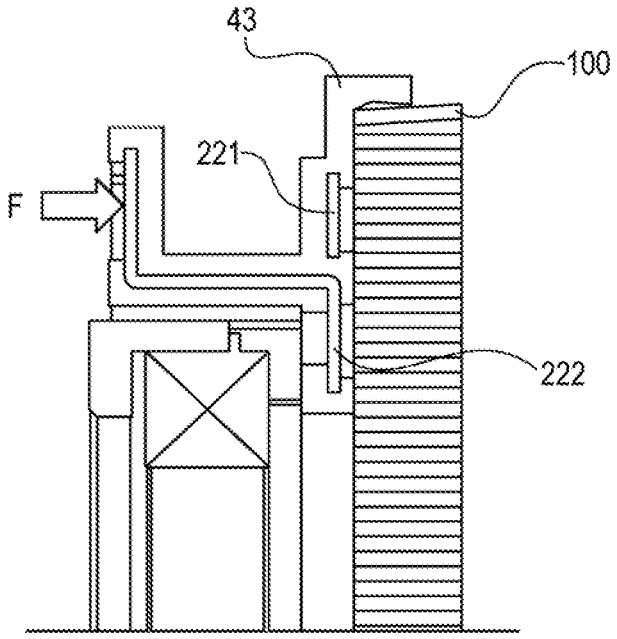
FIG. 10 is a diagram of a cross-sectional view of the drum supporting member according to the embodiment of the present invention.

FIG. 9 is a diagram of a perspective view of the drum supporting member 43. FIG. 10 is a diagram of a cross-sectional view of the drum supporting member.

As shown in FIG. 8, on the far side flange member 211 of the photosensitive drum 20, the electrode terminals 201 and 202 which are biased by a spring is disposed so as to protrude. The electrode terminals 201 and 202 are electrically connected with the heater 220 so that electric power is provided to the heater 220.

As shown in FIGS. 9 and 10, the tips of the electrode terminals 201 and 202 are rotated so as to slide on the surfaces of the conducting plates 221 and 222 (power feeding plates) which are provided in the drum supporting member 43 so that the conducting plates 221 and 222 are continuously electrically connected with the electrode terminals 201 and 202 respectively thereby providing electric power. As explained before, the drum supporting member 43 is integrated into a unit with the drum unit 40 and can be inserted into and pulled from the process unit 10. Thus, for example, the power feeding to the conducting plate 222 is performed via a power feeding terminal (not shown) of the main body side or a power feeding terminal (not shown) of the process unit 10. Further, the power is provided from the position indicated by the arrow F in FIG. 10 and passes through the inside of the drum supporting member 43 and led to the opposed power feeding surface. The power feeding to the conducting plate 221 is similarly performed.

Since the electrically conducting plates 221 and 222 and the electrode terminals 201 and 202 are made of metal, grease is applied on the sliding portions to enhance sliding properties. In this embodiment, non-conductive grease is used since conductive grease would cause short circuit when the grease spreads as time elapses.

Around the image forming units of the image forming apparatus 1, toner is generally scattered and drifted due to, for example, delivery of toner from the developing sleeves 301 and 302 to the photosensitive drum 20 at the developing nip or centrifugal force by rotation of the developing sleeves 301 and 302. Such scattered toner is likely to be attached to the peripheral portions of the image forming units such as the electrode terminals 201 and 202 of the photosensitive drum 20, and the conducting plates 221 and 222 of the drum supporting member 43. In particular, the scattered toner is easy to attach to the surfaces of the electrically conducting plates 221 and 222 since grease is applied on them. Since the main component of toner is resin, when toner particles are sandwiched between the electrode terminals 201 and 202, and the electrically conducting plates 221 and 222, electric conduction may become unstable.

Figure 11:
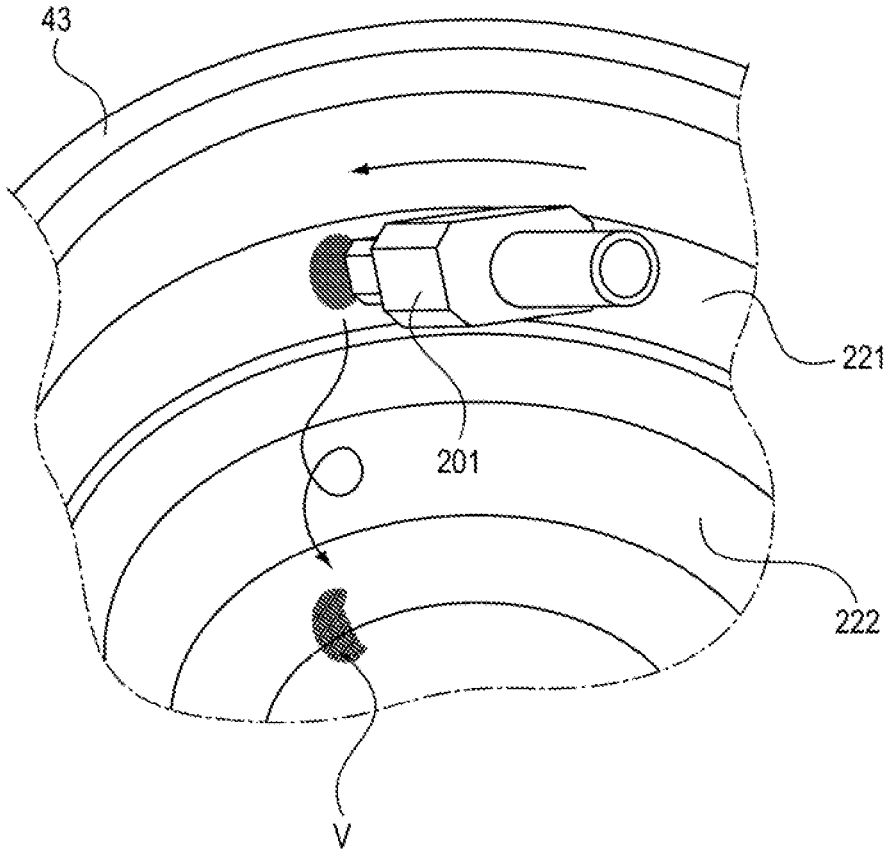
FIG. 11 is a diagram of a perspective view showing the state where an electrode terminal according to the embodiment of the present invention slides on an electrically conductive plate.

FIG. 11 is a diagram of a perspective view showing the state where the electrode terminal 201 slides on the electrically conductive plate 221. When the electrode terminals 201 and 202 rotate and slide on the electrically conducting plates 221 and 222 to which scattered toner is attached while the electrode terminals 201 and 202 are in contact with the electrically conducting plates 221 and 222, the scattered toner is scraped off by the electrode terminals 201 and 222 and a lump of toner V is formed in front of the electrode terminals 201 and 202 in the traveling direction as shown in FIG. 11. At the position where rotational movement of the electrode terminals 201 and 202 changes from an acceleration phase to a deceleration phase, the lump of toner falls and accumulates. When the scattered toner on the electrically conducting plates 221 and 222 is scraped off by the electrode terminals 201 and 202 in this way, the grease applied on the electrically conducting plates 221 and 222 is also scraped off, causing unstable electric conduction due to shortage of grease.

Accordingly, in the present embodiment, the seal brush 100 (seal member) is provided on the drum supporting member 43 as shown in FIG. 9.

Figure 12:
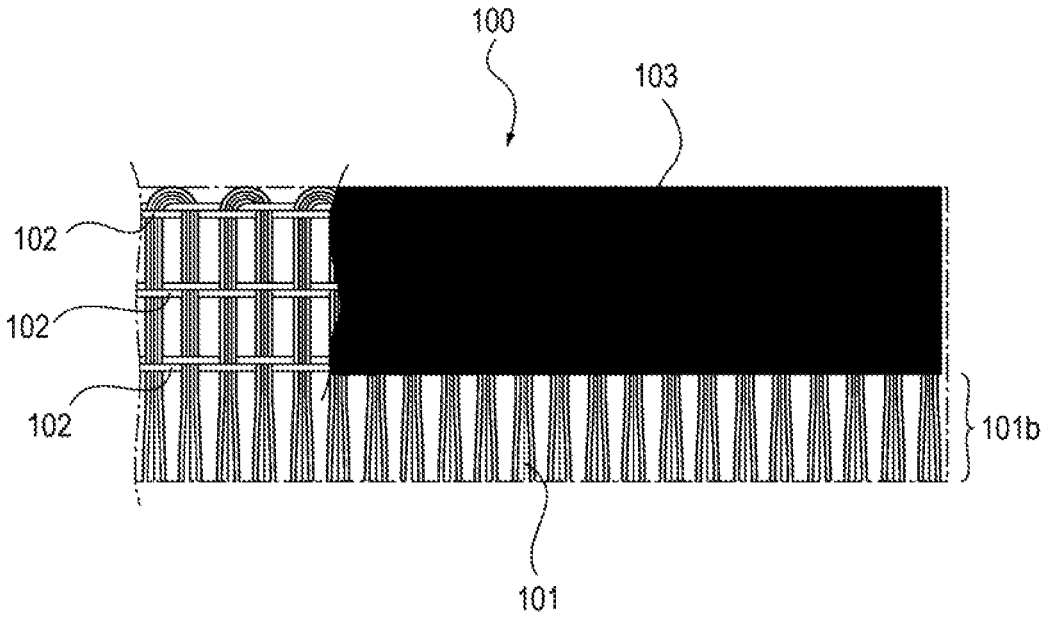
FIG. 12 is a diagram showing the configuration of seal brush according to the embodiment of the present invention.

FIG. 12 is a diagram showing the configuration of the seal brush 100.

As shown in the figure, the seal brush 100 is obtained by sticking the adhesive tape 103 (adhesive layer) on the sewed portion 102 in which the bristle brushes 101 (brush members) are woven in strips. The bristle brushes 101 are disposed in a row to form a planar shape.

The seal brush 100 is formed on the entire circumference of the inner surface of the flange portion provided on the outer peripheral portion of the drum supporting member 43 such that the bristle of the seal brush 100 is in contact with the flange member 211 provided at an end portion of the photosensitive drum 20. The bristle of the seal brush 100 becomes in contact with the flange member 211 such that the bristle moves on to the flange 211 to absorb the dimensional variations of the gap between the drum support member 42 and the photosensitive drum 20.

The adhesive tape 103 of the seal brush 100 is formed so as not to protrude from the flange portion provided on the outer peripheral portion of the drum supporting member 43 in order not to inhibit the flexing freedom of the bristle brush 101. Namely, the seal brush 100 has a plurality of flexible bristle brushes 101 and tip portions 101*b* of the bristle brushes 101 constitutes an extendable and contractible portion.

Further, by providing the seal brush 100 on the inner surface of the flange portion provided on the outer peripheral portion of the drum supporting member 43, almost all space between the flange member 211 and the drum supporting member 43 is sealed by the seal brush 100, thereby preventing the scattered toner from entering the space area in which the electrode terminals 201 and 202, and the electrically conducting plates 221 and 222 are provided.

Next, an explanation will be made to a starting edge portion and a terminal edge portion of the seal brush 100 for pasting.

Figure 13:
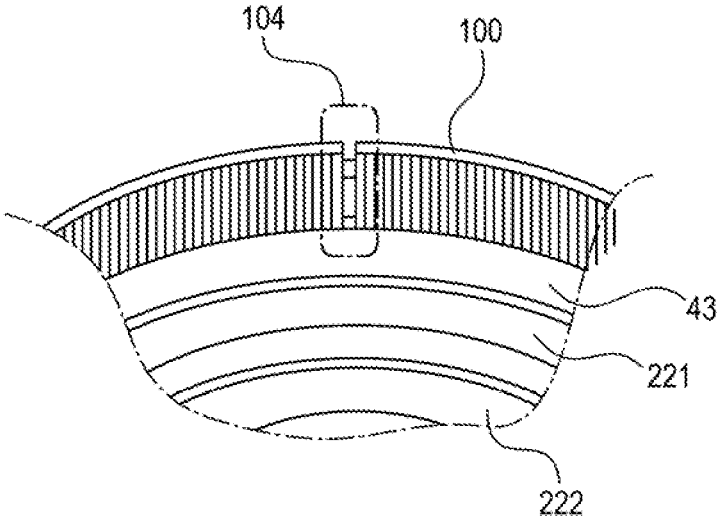
FIG. 13 is a diagram showing a pasting portion of the seal brush according to the embodiment of the present invention.

FIG. 13 is a diagram showing a pasting portion of the seal brush 100.

The seal brush 100 is formed on the entire circumference on the outer peripheral portion of the drum supporting member 43 and is of a strip shape. Thus, as shown in FIG. 13, the pasting joint portion 104 occurs somewhere on the entire circumference. It is desirable that the length of the seal brush 100 is set such that the starting edge portion and the terminal edge portion do not overlap with each other at the pasting joint portion 104 and there is no gap between them. However, the fact that the starting edge portion and the terminal edge portion do not overlap with each other at the pasting joint portion 104 means in other words that it is accepted for a gap to be made and a slight gap between the starting edge portion and the terminal edge portion of the seal brush 100 occurs somewhere on the entire circumference.

In the present embodiment, the pasting joint portion is provided on the region E in FIG. 3. This region E is located upstream with respect to the developing nip and downstream with respect to the cleaning blade 41 in the rotational direction of the photosensitive drum 20 and the region E contains the least amount of scattered toner. Thus, if scattered toner enters from the pasting joint portion of the seal brush 100 located on the region E, the amount of the scattered toner is very small so that it is not likely that the electric conduction between the electrode terminals 201 and 202, and the electrically conducting plates 221 and 222 becomes unstable.

Since the pasting joint portion is provided in the region E which is located in the upper portion in the direction of gravity, the lower portion of the entire circumference is sealed without a gap. Thus, if there occurs a fall of the attached toner and abrasive powder which are scraped off by the electrode terminals 201 and 202, it is suppressed that a further fall from the space between the flange member 211 and the drum supporting member 43 occurs and that the attached toner and abrasive powder are accumulated in the image forming apparatus.

Second Embodiment

Next, the second embodiment of the present invention will be explained. For parts which are the same as or similar to those of the first embodiment, the same reference numerals will be used and duplicate explanation will be omitted. In the following, only the parts different from those of the first embodiment will be explained since the other parts are the same as those of the first embodiment.

Figure 14:
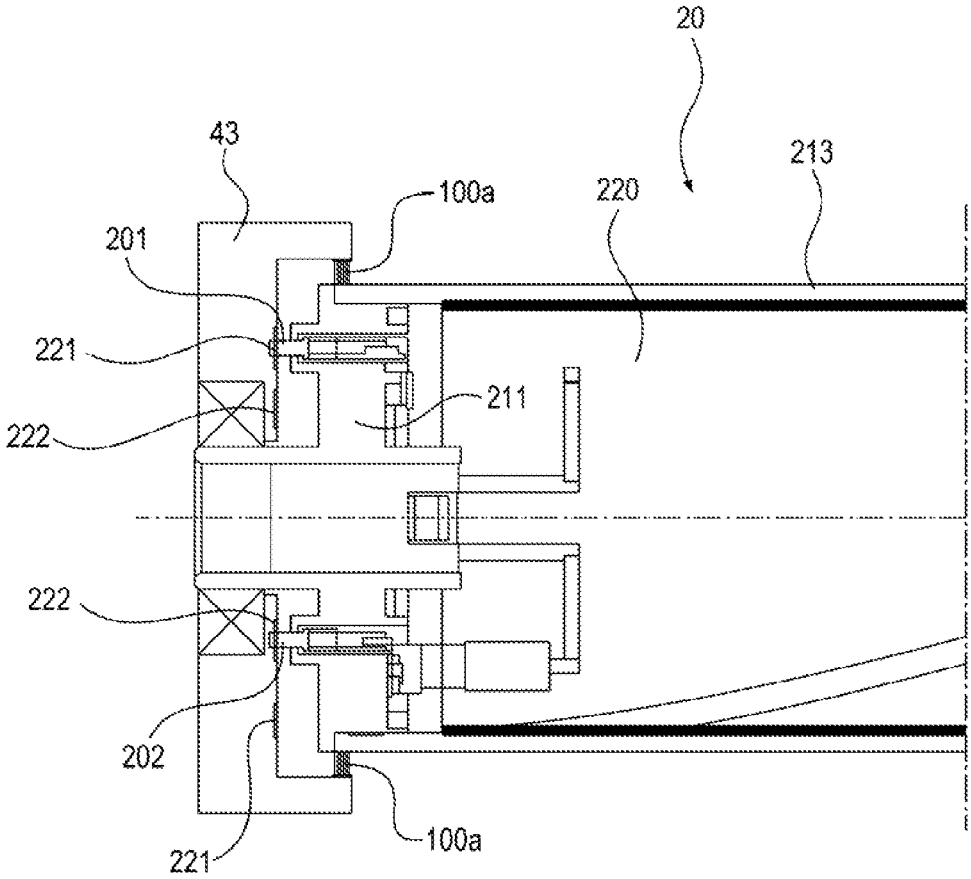
FIG. 14 is a diagram of a cross-sectional view showing a connection portion for connecting the drum supporting member with the photosensitive drum according to a second embodiment of the present invention.

FIG. 14 is a diagram of a cross-sectional view showing a connection portion for connecting the drum supporting member 43 with the photosensitive drum 20.

As shown in the figure, the seal brush 100*a* of the present embodiment is configured to be in contact with the cylindrical surface of the photosensitive drum 20 instead of being in contact with the flange member 211 at a side surface portion. A closed space is formed between the photosensitive drum 20 and the flange member 211 similarly to the first embodiment and the configuration other than the contact direction of the seal brush 100*a* is similar to that of the first embodiment.

Figure 15:
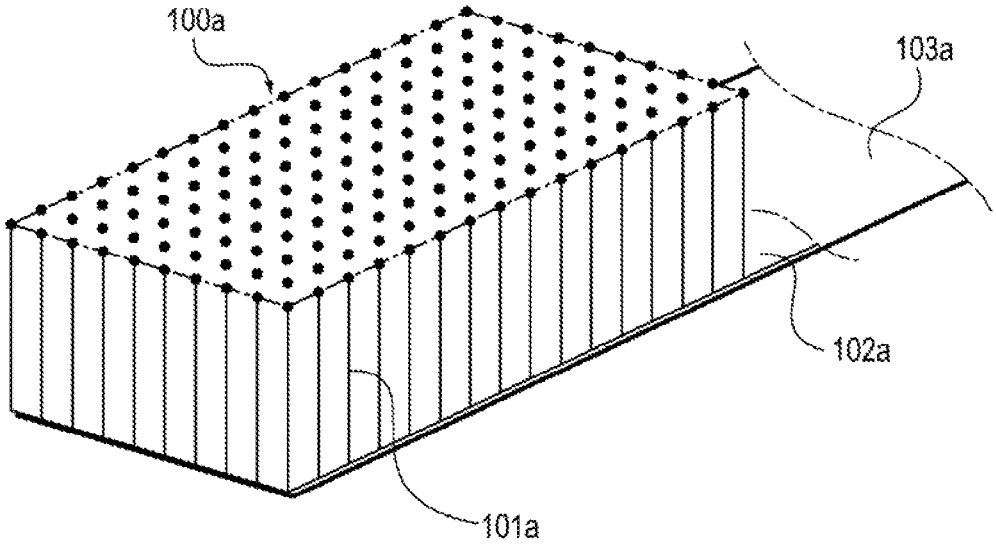
FIG. 15 is a diagram of a perspective view showing the configuration of the seal brush according to the second embodiment of the present invention.

FIG. 15 is a diagram of a perspective view showing the configuration of the seal brush 100*a* according to the present embodiment.

As shown in the figure, the bristle brush 101*a* is formed by the sewed portion 102*a* such that the bristle brush 101*a* has a cubic shape and the adhesive tape 103*a* is pasted on the lower surface of the sewed portion 102*a*.

Other Modification

In the first and second embodiments, the bristle brush is used as the seal member. As a means for sealing the space formed between the side surface of the photosensitive drum and the drum supporting member, a foaming body can be used instead of the brush of the above explained embodiments. When using a foaming body, the effect similar to the above embodiments can be obtained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2015-147430, filed Jul. 27, 2015, which is hereby incorporated by reference herein in its entirety.

What is claimed is:

1. An image forming unit that is detachably attachable to an image forming apparatus that forms an image on a recording medium with toner, the image forming unit comprising:

an image bearing member that bears an image formed with toner, the image bearing member being configured to be rotatable;

a flange provided on an end portion of the image bearing member in a rotary axis direction of the image bearing member, the flange being configured to be rotatable integrally with the image bearing member;

a rotational axis portion provided on the flange, the rotational axis portion protruding from the end portion of the image bearing member toward the outside of the image bearing member in the rotary axis direction of the image bearing member, the rotational axis portion being configured to rotate integrally with the image bearing member;

a supporting portion that rotatably supports the rotational axis portion;

a conducting portion provided on the supporting portion, the conducting portion being configured to electrically conduct electric power supplied from an electric power supplying source of the image forming apparatus;

an electrical contact provided on the flange, the electrical contact being configured to electrically contact with the conducing plate;

a seal member that seals at least a part of a space formed between the supporting portion on which the conducting portion is provided and the flange on which the electrical contact is provided, the conducting portion being disposed in the space, the electrical contact being disposed in the space; and a cleaning portion arranged so as to be opposed to the image bearing member, the cleaning portion being configured to remove residual toner from the image bearing member, wherein the seal member is provided so as to be opposed to a substantially entire circumference of the flange, and wherein a joint portion of the seal member is located (i) upstream of a position where an electrostatic image formed on the image bearing member is developed by a rotatable developing member that supplies the toner toward the position and (ii) downstream of the cleaning portion in a rotational direction of the image bearing member.

2. The image forming unit according to claim 1, wherein the space is formed along a rotational axis direction of the rotational axis portion, and wherein the seal member is provided along the rotational axis direction of the rotational axis portion.

3. The image forming unit according to claim 1, wherein the space is formed along a radius direction of the rotational axis portion, and wherein the seal member is provided along the radius direction of the rotational axis portion.

4. The image forming unit according to claim 1, wherein the seal member is provided such that an end portion of the seal member in a longitudinal direction of the seal member is attached to the supporting portion and another end portion of the seal member in the longitudinal direction of the seal member is in contact with the flange.

5. The image forming unit according to claim 1, further comprising:

a heater that heats the image bearing member, wherein the electrical contact is electrically connected to the heater such that the electrical power conducted via the conducting portion is supplied to the heater.

6. The image forming unit according to claim 1, wherein the rotational axis portion is formed integrally with the flange.

7. The image forming unit according to claim 1, wherein the seal member is a brush member.

8. The image forming unit according to claim 7, wherein the brush member is provided on the supporting portion, and a bristle of the brush member is in contact with the flange.

9. The image forming unit according to claim 1, wherein the conducting portion is a conducting plate, and wherein the electrical contact is an electrode terminal that electrically contacts with the conducting plate.

10. An image forming apparatus that forms an image on a recording medium with toner, the image forming apparatus comprising:

an electric power supplying source;

an image bearing member that bears an image formed with toner, the image bearing member being configured to be rotatable;

a rotatable developing member that supplies the toner toward a position where an electrostatic image formed on the image bearing member is developed, a flange provided on an end portion of the image bearing member in an rotary axis direction of the image bearing member, the flange being configured to be rotatable integrally with the image bearing member;

a rotational axis portion provided on the flange, the rotational axis portion protruding from the end portion of the image bearing member toward outside of the image bearing member in the rotary axis direction of the image bearing member, the rotational axis portion being configured to rotate integrally with the image bearing member;

a supporting portion that rotatably supports the rotational axis portion;

a conducting portion provided on the supporting portion, the conducting portion being configured to electrically conduct electric power supplied from the electric power supplying source;

an electrical contact provided on the flange, the electrical contact being configured to electrically contact with the conducing plate;

a seal member that seals at least a part of a space formed between the supporting portion on which the conducting portion is provided and the flange on which the electrical contact is provided, the conducting portion being disposed in the space, and the electrical contact being disposed in the space, a cleaning portion arranged so as to be opposed to the image bearing member, the cleaning portion being configured to remove residual toner from the image bearing member, wherein the seal member is provided so as to be opposed to a substantially entire circumference of the flange, and wherein a joint portion of the seal member is located upstream of the position where an electrostatic image formed on the image bearing member is developed by the rotatable developing member and downstream of the cleaning portion in a rotational direction of the image bearing image.

11. The image forming apparatus according to claim 10, wherein the space is formed along a rotational axis direction of the rotational axis portion, and wherein the seal member is provided along the rotational axis direction of the rotational axis portion.

12. The image forming apparatus according to claim 10, wherein the space is formed along a radius direction of the rotational axis portion, and wherein the seal member is provided along the radius direction of the rotational axis portion.

13. The image forming apparatus according to claim 10, wherein the seal member is provided such that an end portion of the seal member in a longitudinal direction of the seal member is attached to the supporting portion and another end portion of the seal member in the longitudinal direction of the seal member is in contact with the flange.

14. The image forming apparatus according to claim 10, further comprising:

a heater that heats the image bearing member, wherein the electrical contact is electrically connected to the heater such that the electrical power conducted via the conducing portion is supplied to the heater.

15. The image forming apparatus according to claim 7, wherein the rotational axis portion is formed integrally with the flange.

16. The image forming apparatus according to claim 10, wherein the seal member is a brush member.

17. The image forming apparatus according to claim 16, wherein the brush member is provided on the supporting portion, and a bristle of the brush member is in contact with the flange.

18. The image forming apparatus according to claim 10, wherein the conducting portion is a conducting plate, wherein the electrical contact is an electrode terminal that electrically contacts with the conducting plate.

* * * * *